US007039352B2

(12) United States Patent
Arcaro et al.

(10) Patent No.: US 7,039,352 B2
(45) Date of Patent: May 2, 2006

(54) THERMALLY SELF-REGULATING FUSING SYSTEM FOR THERMAL TRANSFER OVERCOAT DEVICE INCLUDING STATIONARY HEATING ASSEMBLY

(75) Inventors: David J. Arcaro, Flagstaff, AZ (US); Wayne E. Foote, Eagle, ID (US); Mark Wright, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 274 days.

(21) Appl. No.: 10/616,816

(22) Filed: Jul. 10, 2003

(65) Prior Publication Data

US 2005/0008410 A1 Jan. 13, 2005

(51) Int. Cl.
*G03G 15/20* (2006.01)

(52) U.S. Cl. ..... 399/328

(58) Field of Classification Search ..... 399/328, 399/320, 335, 67, 69
See application file for complete search history.

(56) References Cited

U.S. PATENT DOCUMENTS

| | | | | |
|---|---|---|---|---|
| 5,278,618 | A | 1/1994 | Masao et al. | |
| 5,343,280 | A | 8/1994 | Hiromitsu et al. | |
| 5,367,369 | A | 11/1994 | Hironobu et al. | |
| 5,732,318 | A * | 3/1998 | Natsuhara et al. | 399/329 |
| 5,785,795 | A | 7/1998 | Ryan et al. | |
| 6,671,489 | B1 * | 12/2003 | Natsuhara et al. | 399/329 |
| 2002/0109590 | A1 * | 8/2002 | Parsons | 340/540 |

FOREIGN PATENT DOCUMENTS

JP 07044038 A * 2/1995

* cited by examiner

*Primary Examiner*—Quana Grainger

(57) ABSTRACT

An implementation of a technology is described herein for a fusing system comprising a heating assembly comprising a thermally self-regulating heating element.

17 Claims, 3 Drawing Sheets

THERMALLY SELF-REGULATING FUSING SYSTEM FOR THERMAL TRANSFER OVERCOAT DEVICE INCLUDING STATIONARY HEATING ASSEMBLY

BACKGROUND

One of the most common uses for a fusing system is in the realm of electrophotographic printing. The typical fusing system in an electrophotographic printer or copier is composed of two heated platen rollers. When a print medium with a developed image pass between them, the heat melts the toner and the pressure between the rollers physically fuses the molten thermal plastic (e.g., toner) to the medium.

A variety of different techniques have been developed to heat a fusing roller. One of the most common techniques uses a high-power tungsten filament quartz lamp inside the hollow platen roller. The lamp is turned on to heat the fusing roller during printing. The quartz lamp typically requires an active temperature controller to monitor and manage the temperature of the lamp.

While fusing systems are most commonly used in electrophotographic printing, they are also used in other applications and fields.

SUMMARY

Described herein is a technology for a fusing system comprising a heating assembly comprising a thermally self-regulating heating element.

BRIEF DESCRIPTION OF THE DRAWINGS

The same numbers are used throughout the drawings to reference like elements and features.

DETAILED DESCRIPTION

The following description sets forth one or more exemplary implementations of a thermally self-regulating fusing system. The inventors intend these exemplary implementations to be examples. The inventors do not intend these exemplary implementations to limit the scope of the claimed present invention. Rather, the inventors have contemplated that the claimed present invention might also be embodied and implemented in other ways, in conjunction with other present or future technologies.

An example of an embodiment of the thermally self-regulating fusing system may be referred to as an "exemplary self-regulating fuser."

Figure 2:
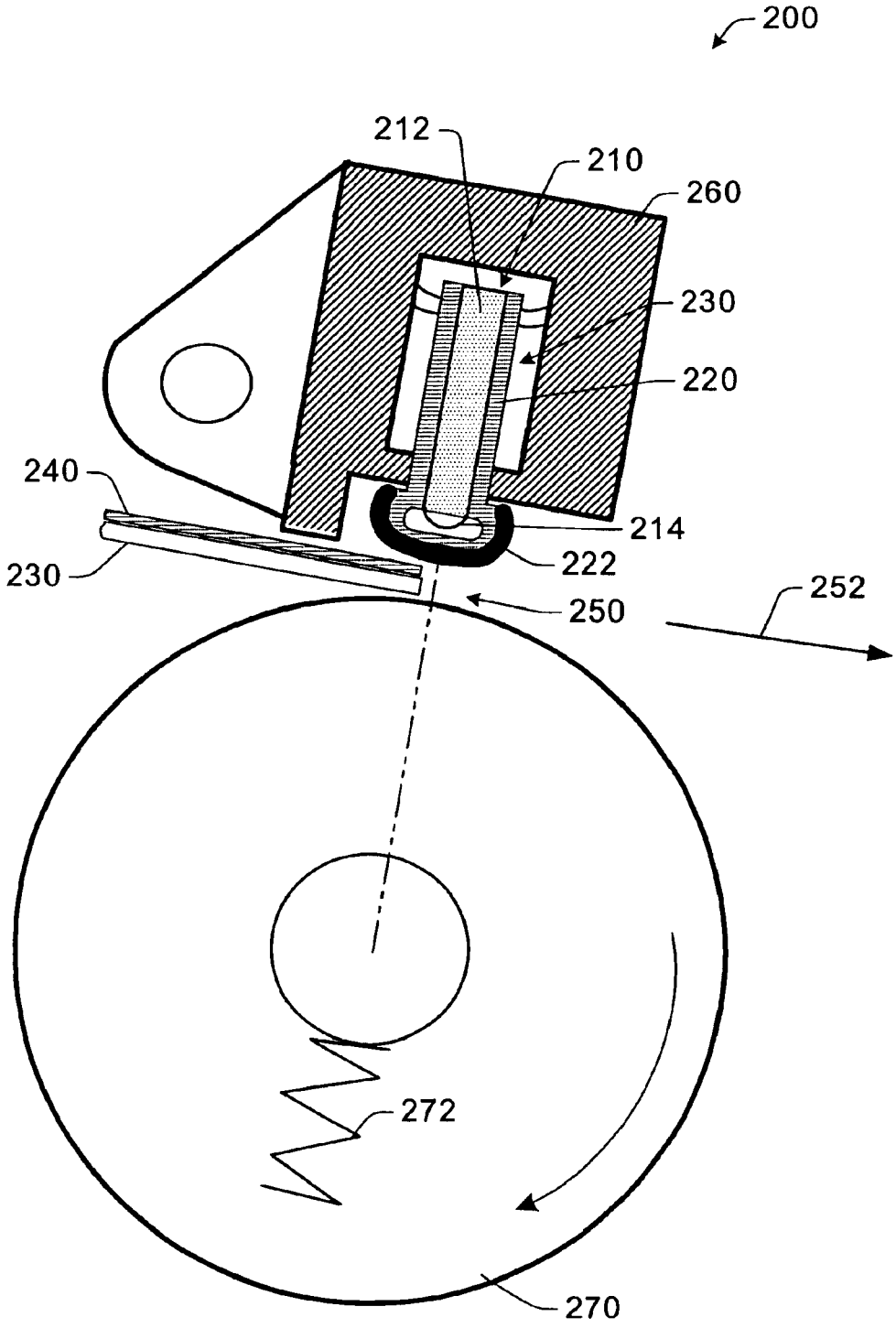
FIG. 2 illustrates a thermally self-regulating fusing system in accordance with an implementation described herein.
Figure 3:
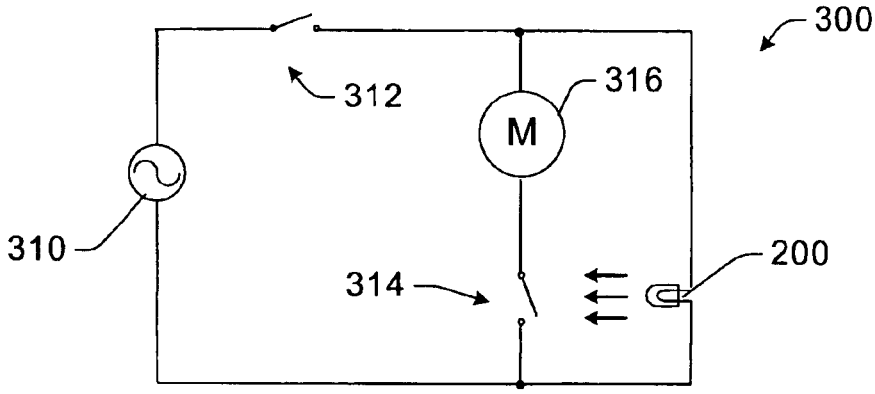
FIG. 3 is a circuit capable of implementing (wholly or partially) an embodiment described herein.
Figure 4:
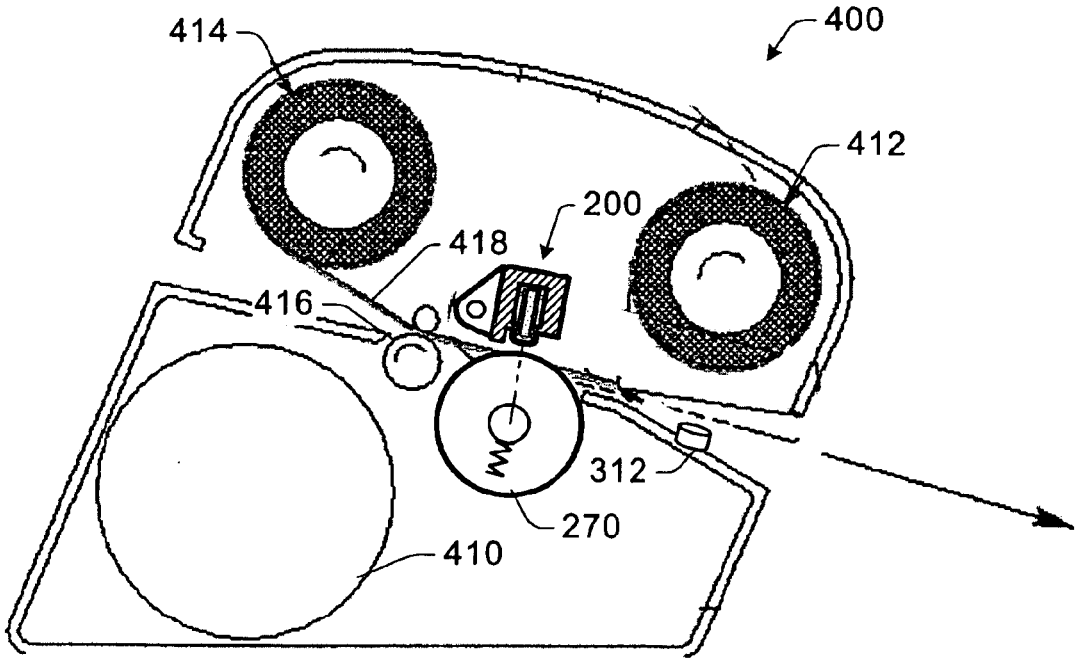
FIG. 4 is an example of a thermal transfer overcoat (TTO) device capable of implementing (wholly or partially) an embodiment described herein.

The one or more exemplary implementations, described herein, of the present claimed invention may be implemented (in whole or in part) by a thermally self-regulating fusing system 200 (of FIG. 2), the circuitry of FIG. 3, and/or by a thermal transfer overcoat device 400 (of FIG. 4).

Thermal Transfer Overcoating

While fusing systems are commonly used in electrophotographic printing, there are other possible fields where they may be used. One example is in the realm of thermal transfer overcoat (TTO) devices.

Thermal transfer overcoating ("TTOing") is the application of a thin adhesive coating to pre-printed pages to provide durability and a glossy finish. In other words, TTOing is effectively a lamination of a printed page. The typical motivation for doing this is to seal the printed page, thereby making it waterfast and lightfast.

Figure 1:
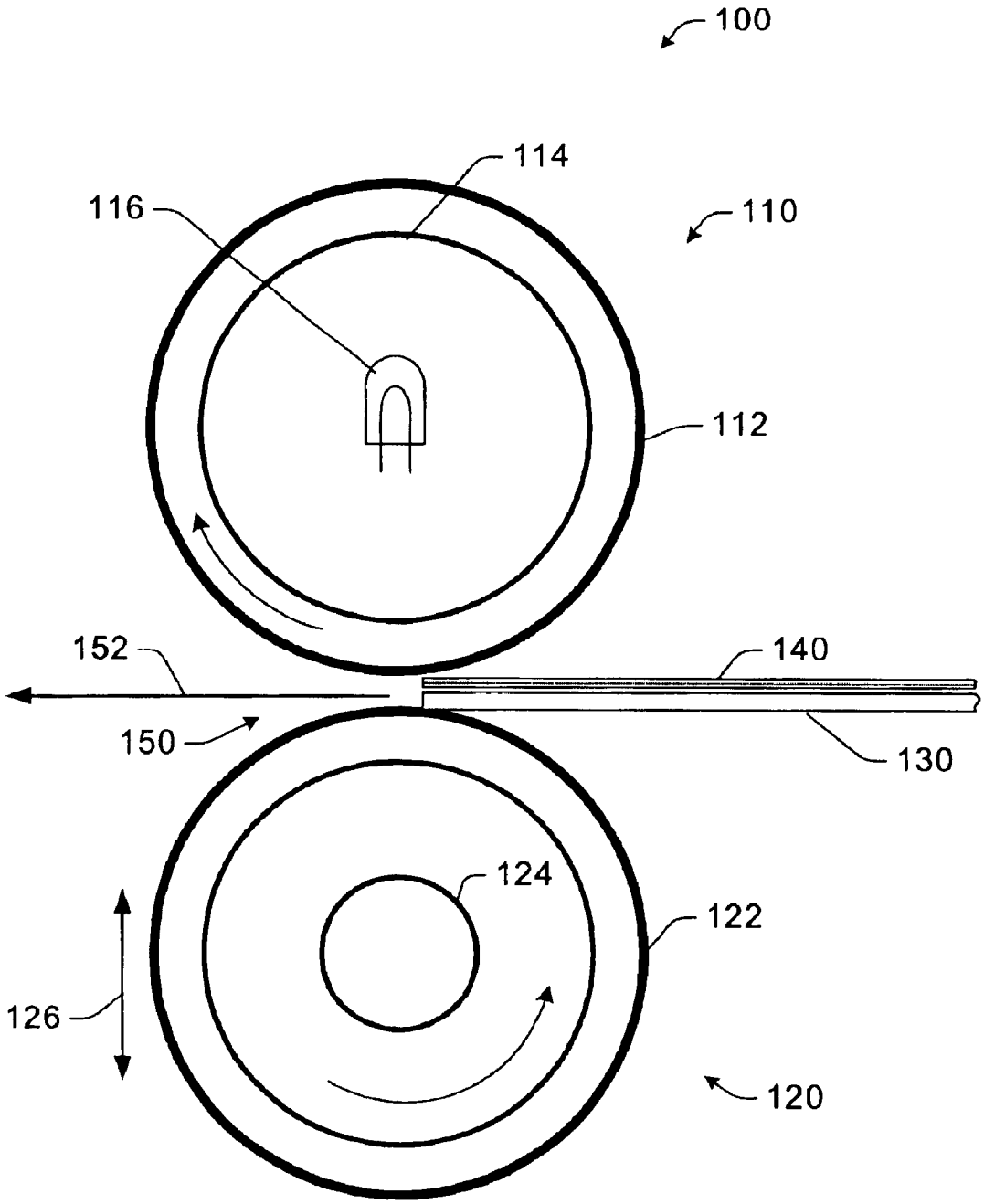
FIG. 1 illustrates a dual-roller fusing system of a thermal transfer overcoat (TTO) device.

FIG. 1 shows a TTO device that uses conventional fusing technology. It has a conventional-type fuser roller pair 100 with an internally heated silicone "hot" roller 110 and a silicone pressure roller 120. To allow conventional internal heating with a quartz lamp 116, the hot roller's core 114 is made from a hollow aluminum extrusion. The pressure roller 120 utilizes a conventional steel or aluminum shaft 124 as its core. Surrounding each roller is a thick silicone cushion 112 and 122, respectively.

TTOing may be performed by running to-be-coated paper 130 and thin (e.g., 4-micron thick), clear nitrocellulose coating on a donor film 140 together through a nip 150 where heat and pressure are applied. For ease of illustration, the donor film 140 is depicted as a sheet. However, it typically is a continuous web.

Arrow 152 shows the path of the sheet media. The heat and pressure melts the adhesive on the nitrocellulose coating causing it to adhere to the paper. After that, the donor film is released, which leaves a waterfast and lightfast coated paper.

While effective, this approach is relatively costly. Examples of components of this approach that come at a relatively high cost include: the quartz-lamps, temperature sensors, microprocessors to turn lamps on/off, solid-state relays running AC power to/from the lamps, and the silicone rollers.

Furthermore, in order to achieve uniform temperature around the circumference of the rollers, they must be pre-heated with the fusing nip open (to prevent uneven heating across the rollers). Thus, there is additional expense required for the components to open and closes the nip. These components include a cam mechanism, larger drive motor, clutches, and nip position feedback. The up-and-down translational motion of roller 120 is indicated by double-headed arrow 126. Such systems typically require an anticipated automatic temperature controller.

The exemplary self-regulating fuser, described herein, overcomes many of the drawbacks of using a conventional dual-roller fusing system in a TTO device or in other devices that employ a fusing function.

With the exemplary self-regulating fuser, the temperature is self-regulating; therefore, an automated temperature control system is not necessary. With the exemplary self-regulating fuser, the fuser may be pre-heated with the nip closed; therefore, a high-force cam mechanism, reversible drivetrain motor, and nip position feedback (optical sensor, motor stall detection, etc.) is not necessary. With the exemplary self-regulating fuser, cooling fans are not necessary because of its high thermal efficiency.

The exemplary self-regulating fuser does not need a micro-controller or a DC power supply for temperature regulation and opening/closing the nip.

PTC Ceramic

The exemplary self-regulating fuser uses a heating element made of positive temperature coefficient (PTC) ceramic. The specific PTC ceramic used may be one of the many available in the family of PTC ceramic materials. Those of ordinary skill in the art are familiar with PTC ceramics.

PTC ceramics are inherently self-regulating in temperature. PTC ceramics start with a relatively low resistance at ambient temperature. However, as it heated, a PTC ceramic offer increasingly and significantly more resistance as it reaches its design temperature threshold (sometimes called its "Curie temperature threshold"). Consequently, the PTC ceramics inherently achieve temperature control without any computerized controller to manage and maintain its temperature. Also, these PTC ceramics have relatively fast warm-up times.

Exemplary PTC Fusing System

FIG. 2 shows a thermally self-regulating fusing system 200, which may be part of a TTO device or other device employing a fusing function. The thermally self-regulating fusing system 200 is relatively stationary. It does not have mechanics enabling it to rotate or move up-and-down like the rollers of FIG. 1 do.

The thermally self-regulating fusing system 200 employs positive temperature coefficient (PTC) ceramic 212 as the heating element. A PTC ceramic is self-regulating in temperature and needs no external temperature control system.

The thermally self-regulating fusing system 200 has a heating assembly 230 that includes an aluminum extrusion 220, its nip cap 222, and a PTC sub-assembly 210. Arrow 252 shows the path of the sheet media.

The PTC sub-assembly 210 includes the PTC ceramic 212 wrapped in a flexible polyimide film circuit 214 (such as Kapton® by DuPont). The polyimide film circuit provides an electric potential across the PTC ceramic's short dimension.

This PTC sub-assembly 210 is then pressed into a prestressed aluminum extrusion 220. This may be done with the aid of some thermally conductive high-temperature grease.

The tip surface of the aluminum extrusion 220 is wrapped with a self-adhesive silicone elastomer-PTFE laminate (e.g., 0.5 mm thick) which provides the necessary compliance to form a fusing nip area 250, local compliance to accommodate media surface irregularities, and a low coefficient of friction to allow paper or other suitable media 230 and TTO film 240 to slide smoothly through the nip area 250. For ease of illustration, the TTO film 240 is depicted as a sheet. However, it typically is a continuous web.

This laminate forms a "nip cap" 222. This may also be called a "covering" for of the heating assembly that is exposed to the nip area 250. It is desirable for the nip cap 222 to have compliance towards the film-side of the nip to force the coating into the topology of the media 230.

The nip cap 222 also has a PTFE (e.g., Teflon®) coating to reduce the sliding coefficient of friction between the heating assembly and TTO film as much as possible. Thus, the PTFE-coated nip cap 222 is compliant and has a low coefficient of sliding friction.

The heating assembly 260 is snapped into a molded plastic housing 260 that provides a pivoting mount point and some thermal insulation through judicious use of air gaps. To achieve fast warm-up and low power consumption, other components and materials of the thermally self-regulating fusing system 200 are chosen that have minimal thermal capacitance and conductivity.

The heating assembly 260 is stationary. It does not rotate like the rollers of FIG. 1 do. Except for biasing for compliance, it does not move up-or-down like roller 120 of FIG. 1 does.

FIG. 2 shows a pressure roller 270 and its biasing spring 272. The roller 270 and the heating assembly 260 form the nip area 250 (or simply "nip") through which the media 230 and TTO film 240 pass through in the direction of arrow 252.

A pressure roller 270 may be fabricated from a rigid material with low thermal conductivity, such as fiber reinforced plastic or glass tubing. However, good results may be achieved with highly thermally conductive thin wall aluminum tubing as well.

Except for bias (for compliance), the pressure roller does not move up-or-down. It does not have mechanics enabling it to move translationally like the roller 120 of FIG. 1 does.

PTC Sub-assembly

The PTC sub-assembly 210 includes the PTC ceramic 212 wrapped in the flexible polyimide film circuit 214 (such as Kapton® by DuPont). The flexible polyimide film circuit 214 provides the electrical interconnect with the PTC ceramic 212.

The polyimide film is an electrical insulation material that has electrical contacts on one side (the side in contact with the PTC ceramic) and is electrically insulated on the other. It is also resistant to damage from high-temperatures.

Since the PTC ceramic is typically brittle, it may not be manufactured in a long strip as illustrated in FIG. 2. Rather, PTC ceramic component of the thermally self-regulating fusing system 200 may be composed of several small pieces of ceramic. The flexible film 214 folds around the multiple pieces of PTC ceramic to maintain electrical contact with the pieces.

Also, polyimide film 214 electrically isolates the PTC ceramic 212 from the aluminum extrusion 220. However, the film conducts heat well from the ceramic because it is so thin (e.g., about 1 mm (0.004 inches).

Circuit

FIG. 3 shows a circuitry 300 that may be used with a TTO device that uses the thermally self-regulating fusing system 200. The circuitry may use a low-cost AC-only electrical system. The circuitry has an AC power supply 310.

A single micro-switch 312 with a long lever is activated by the leading edge of the media when it is placed in the input. This activation turns on the thermally self-regulating fusing system 200 so that it can begin warm up.

A bi-metallic switch 314 is in close proximity to the thermally self-regulating fusing system 200. It closes when the fuser reaches its operating temperature. When the bimetallic switch closes it allows a universal motor 316 to drive the TTO device (of the thermally self-regulating fusing system 200) until the trailing edge of the media clears the long lever of the micro-switch 312, thereby turning off all power to the device.

These two switches may also be viewed as sensors. The single micro-switch 312 is a media sensor and the bi-metallic switch 314 is a temperature sensor.

Exemplary TTO Device

FIG. 4 illustrates an exemplary TTO device 400 that may implement the thermally self-regulating fusing system 200 therein. The TTO device 400 includes a single motor 410, a stationary heating element 200 (which is the thermally self-regulating fusing system 200), a pressure roller 270, an overdriven film take-up roll 412, a film supply roller 414, and a pinch roller 416. Also shown in FIG. 4 is the long lever of the micro-switch 312.

These items work in concert with TTO film 418 to provide pre-feed of the media upon insertion, feed both media and film through the nip of the thermally self-regulating fusing system 200, and out of the device.

What is claimed is:

1. A fusing system comprising:

a stationary heating assembly comprising a thermally self-regulating heating element comprising a positive temperature coefficient (PTC) ceramic; and a pressure roller proximately positioned relative to the heating assembly such that the pressure roller and the heating assembly form a nip area therebetween configured to receive sheet media;

wherein the heating assembly further comprises a fixed covering exposed to the nip area, the fixed covering being compliant and having a low coefficient of sliding friction, wherein the heating assembly further comprises a flexible polyimide film circuit around the PTC ceramic.

2. A system as recited in claim 1, wherein the heating assembly is stationary relative to both rotational and translational motion.

3. A system as recited in claim 1, wherein the flexible polyimide film circuit is around and in contact with the PTC ceramic, wherein the film circuit is electrically conductive on the side in contact with the PTC ceramic, and electrically insulating on the other side.

4. A system as recited in claim 1, wherein the heating assembly further comprises an aluminum extrusion housing the PTC ceramic.

5. A system as recited in claim 1, wherein the covering comprises a compliant elastomer having a surface covered by a friction reducing coating.

6. A fusing system comprising:

a stationary heating assembly comprising a thermally self-regulating heating element comprising a positive temperature coefficient (PTC) ceramic; and a pressure roller proximately positioned relative to the heating assembly such that the pressure roller and the heating assembly form a nip area therebetween configured to receive sheet media;

wherein the heating assembly further comprises a fixed covering exposed to the nip area, the fixed covering being compliant and having a low coefficient of sliding friction, wherein the covering comprises a silicone elastomer.

7. A system as recited in claim 6 wherein the silicone elastomer is coated with PTFE.

8. A thermal transfer overcoat (TTO) device comprising a fusing system comprising:

a stationary heating assembly comprising a thermally self-regulating heating element comprising positive temperature coefficient (PTC) ceramic;

a pressure roller proximately positioned relative to the heating assembly so that they form a nip area therebetween that is configured to receive sheet media;

wherein the heating assembly further comprises a covering exposed to the nip area, the covering being compliant while having a low coefficient of sliding friction;

wherein the heating assembly further comprises a flexible polyimide film circuit around the PTC ceramic.

9. A fusing system comprising a stationary heating assembly comprising a thermally self-regulating heating element, wherein the heating assembly further comprises a compliant elastomer covering that has a low coefficient of sliding friction, wherein the covering comprises a silicone elastomer coated with PTFE.

10. A system as recited in claim 9, further comprising a pressure roller proximately positioned relative to the heating assembly so that they form a nip area therebetween that is configured to receive sheet media.

11. A system as recited in claim 9, wherein the heating assembly is stationary relative to both rotational and translational motion.

12. A system as recited in claim 9, wherein the thermally self-regulating heating element is comprised of positive temperature coefficient (PTC) ceramic.

13. A system as recited in claim 12, wherein the heating assembly further comprises a flexible polyimide film circuit around the PTC ceramic.

14. A fusing system comprising a stationary heating assembly comprising a thermally self-regulating heating element, wherein the thermally self-regulating heating element is comprised of positive temperature coefficient (PTC) ceramic, wherein the heating assembly further comprises a flexible polyimide film circuit around the PTC ceramic, wherein the film circuit is electrically conductive on the side in contact with the PTC ceramic, but electrically insulating on the other side.

15. A thermal transfer overcoat (TTO) device comprising:

a fusing system comprising:

a stationary heating assembly comprising a thermally self-regulating heating element composed of positive temperature coefficient (PTC) ceramic;

a pressure roller proximately positioned relative to the heating assembly so that they form a nip area therebetween that is configured to receive sheet media;

wherein the heating assembly further comprises a compliant elastomer covering that has a low coefficient of sliding friction;

a paper feed mechanism configured to feed paper into the nip area;

a TTO film supply roller configured to supply TTO film to the nip area.

16. A TTO device as recited in claim 15, wherein the heating assembly is stationary relative to both rotational and translational motion.

17. A circuit for a thermal transfer overcoat (TTO) device comprising;

an AC power supply;

a paper sensor switch configured to close and complete a circuit with the AC power supply when it senses paper in the TTO device, wherein the completion of the circuit supplies AC power to a fuser system that is configured to heat when power is supplied;

a temperature sensor switch in proximity to the fuser system configured to close when the fuser system has reached a defined operating temperature;

a motor configured to receive AC power when both sensor switches are closed and to pull paper through the fuser system.

* * * * *

UNITED STATES PATENT AND TRADEMARK OFFICE

CERTIFICATE OF CORRECTION

PATENT NO. : 7,039,352 B2
APPLICATION NO. : 10/616816
DATED : May 2, 2006
INVENTOR(S) : David J. Arcaro et al.

It is certified that error appears in the above-identified patent and that said Letters Patent is hereby corrected as shown below:

In column 6, line 51, in Claim 17, delete "comprising;" and insert -- comprising: --, therefor.

Signed and Sealed this

Sixth Day of July, 2010

David J. Kappos

David J. Kappos
*Director of the United States Patent and Trademark Office*